US009243473B2

(12) United States Patent
Yang et al.

(10) Patent No.: US 9,243,473 B2
(45) Date of Patent: Jan. 26, 2016

(54) SWELLABLE PACKER

(75) Inventors: Liuqing Yang, Rosharon, TX (US); Xiaohong Ren, Sugar Land, TX (US); Camilla Werningsen, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 260 days.

(21) Appl. No.: 13/545,148

(22) Filed: Jul. 10, 2012

(65) Prior Publication Data

US 2014/0014374 A1 Jan. 16, 2014

(51) Int. Cl.
*E21B 33/12* (2006.01)
*E21B 33/127* (2006.01)

(52) U.S. Cl.
CPC ..... *E21B 33/1277* (2013.01)

(58) Field of Classification Search
CPC ... E21B 33/127; E21B 33/1277; E21B 33/12; E21B 33/1208; E21B 33/1216
USPC ..... 166/387, 179, 127, 132; 277/334, 340
See application file for complete search history.

(56) References Cited

U.S. PATENT DOCUMENTS

| | | | | |
|---|---|---|---|---|
| 7,373,991 | B2 | 5/2008 | Vaidya et al. | |
| 2009/0205817 | A1 * | 8/2009 | Gustafson et al. | 166/118 |
| 2009/0242189 | A1 * | 10/2009 | Vaidya et al. | 166/134 |
| 2013/0161000 | A1 * | 6/2013 | Broussard et al. | 166/278 |

* cited by examiner

*Primary Examiner* — Yong-Suk (Philip) Ro
(74) *Attorney, Agent, or Firm* — David J. Groesbeck

(57) ABSTRACT

A packer that is usable with a well includes a tubular inner core and a swellable body that is mounted to the core and is adapted to swell in the presence of a triggering agent to form an annular seal in the well. The swellable body longitudinally extends between first and second ends of the body and includes a first region that is located between the first and second ends of the swellable body to swell at a first rate and at least a second region that is located closer to one of the first and second ends than the first region to swell at a second rate less than the first rate.

10 Claims, 6 Drawing Sheets

SWELLABLE PACKER

BACKGROUND

A packer is a device that is used in a well to form an annular seal between an inner tubular member and a surrounding outer tubular member (a casing string or a liner, as just a few examples) or borehole wall. As examples, the inner tubular member may be a tubular string (a test string, production string, work string, etc.) or may be part of a downhole tool (a formation isolation valve, bridge plug, etc.).

One type of conventional packer has a seal element that is formed from a set of elastomer seal rings. The rings are sized to pass through the well when the packer is being run downhole into position. When the packer is in the appropriate downhole position and is to be set, gages of the packer compress the rings to cause the rings to radially expand to form the annular seal.

A weight-set packer uses the weight of the string and possibly the weight of additional collars to compress the packer's seal rings. In this regard, when the packer is to be set, the string may be mechanically manipulated from the surface of the well to initiate the release of the weight on the rings.

A hydraulically-set packer uses fluid pressure to compress the seal rings. The fluid pressure may be, as examples, pressure that is communicated downhole through a tubing string; annulus pressure; or pressure that is communicated downhole through a control line.

Other types of packers may include seal elements that are set without using compression. For example, a packer may have an inflatable bladder that is radially expanded to form an annular seal using fluid that is communicated into the interior space of the bladder through a control line. As another example, a swellable packer has a swellable material that swells in the presence of a well fluid or other triggering agent to form an annular seal.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In some implementations, a packer that is usable with a well includes a tubular inner core and a swellable body that is mounted to the core and is adapted to swell in the presence of a triggering agent to form an annular seal in the well. The swellable body longitudinally extends between first and second ends of the body and includes a first region that is located between the first and second ends of the swellable body to swell at a first rate and at least a second region that is located closer to one of the first and second ends than the first region to swell at a second rate less than the first rate.

In some implementations, a technique includes using a swellable body that longitudinally extends along a tubular member in a well to form an annular seal in the well and preventing fluid from being trapped by the swellable body in response to the swellable body radially expanding. Preventing the fluid from being trapped includes radially expanding a first region of the swellable body between ends of the body at a first rate and radially expanding second regions of the swellable body closer to the ends than the first region at a second rate less than the first rate.

Advantages and other features will become apparent from the following drawing, description and claims.

DETAILED DESCRIPTION

Figure 1:
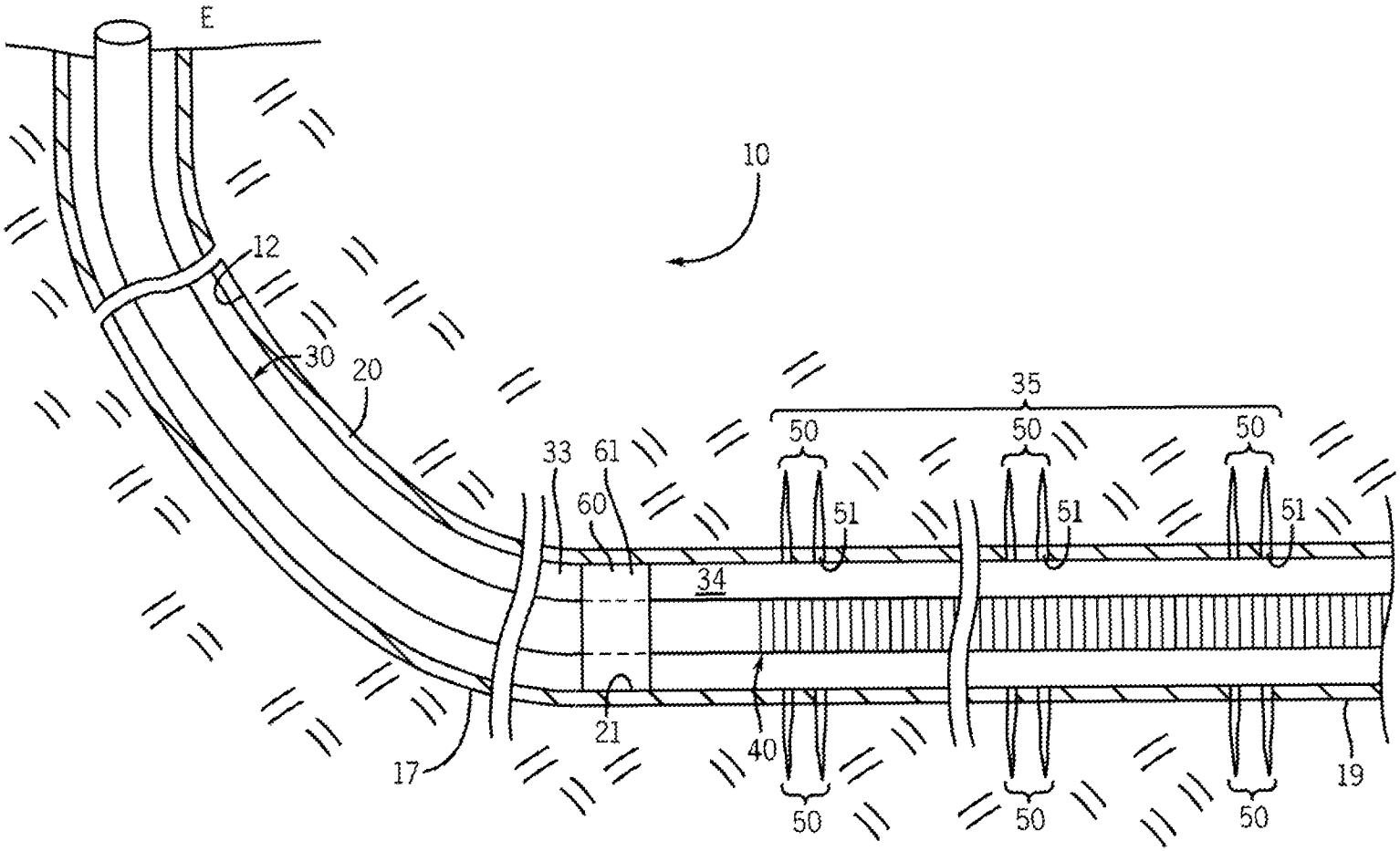
FIG. 1 is a schematic diagram of a well according to an example implementation.

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In general, systems and techniques are disclosed herein for purposes of controlling the longitudinal profile of a swellable element, or body, of a swellable packer as the body swells and radially expands so that fluid is not trapped between the body and the casing or wellbore wall against which the body otherwise seals. More specifically, in accordance with example implementations that are disclosed herein, a swellable body of a swellable packer is constructed in a manner that eliminates, or at least suppresses, an "end effect": a phenomena observed in a homogenous swellable body that nominally has the same swelling rate throughout in which end regions of the body actually swell relatively faster than the central portion of the body.

The swellable packers that are disclosed herein may take on numerous forms, depending on the particular implementation. As non-limiting examples, in accordance with example implementations, the swellable packers may be gravel packing packers, zonal isolation packers, bridge plugs, and so forth. The swellable packers may be used to form seals inside tubular members, such as casing strings and liners, and may be used to seal against uncased wellbore walls, depending on the particular implementation. The swellable packers that are disclosed herein may be used in a wide variety of downhole operations, such as gravel packing operations, stimulation operations, fracturing operations, production operations, perforating operations, injection operations, testing operations, and so forth. Moreover, the swellable packers that are disclosed herein may be used in temporary workover operations (testing, stimulation and perforating operations, for example), as well as in permanent completions.

Although packers are specifically disclosed herein that have a swellable body as the sole sealing element, the techniques and systems that are disclosed herein may likewise be applied to a composite packer that includes a swellable body and another packer-type sealing element that is non-swellable, in accordance with some implementations. For example, the swellable body may be disposed on a packer that also includes an elastomer seal ring that is compressed between gages to form an annular seal in addition to the annular seal that is formed by a swellable body. Thus, many variations are contemplated, which are within the scope of the appended claims.

Referring to FIG. 1, as a more specific example, in accordance with some implementations, a swellable packer 60 may be deployed downhole in a well 10 (a terrestrial well or a subsea well) as part of a tubing string 30. As depicted in FIG. 1, the tubing string 30 extends downhole from the Earth surface E into a wellbore 12, which may traverse one or more formations (as a non-limiting example). For this example, the wellbore 12 extends from a heel end 17 to a toe end 19 of a lateral segment of the wellbore 12 through one or multiple zones, or stages 35 (one stage 35 being depicted in FIG. 1), of the well 10.

Moreover, for the example that is depicted in FIG. 1, the wellbore 12 is at least partially cased by a tubing string, called a "casing 20 string" herein, which, in general, lines and supports the wellbore 12. For the state of the well 10 depicted in FIG. 1, one or more prior perforating operations may have been performed in the well inside the stage 35 to form corresponding perforations 51 in the casing string 20 as well as corresponding perforation tunnels 50 into the surrounding formation(s).

For this exemplary application of the swellable packer 60, the tubing string 30 is a production tubing string, which contains one or more screen assemblies 40 (one screen assembly 40 being depicted in FIG. 1) that are positioned in the stage 35 for purposes of receiving produced fluid from the surrounding formation(s). In general, the swellable packer 60, when set, forms an annular seal between the exterior of the tubing string 30 and the interior surface of the casing string 20. Alternatively, in further implementations, when the swellable packer 60 is disposed in an uncased wellbore, the packer 60, when set, forms an annular seal between the exterior of the tubing string 30 and the uncased wellbore wall. Thus, many variations are contemplated, which are within the scope of the appended claims.

The swellable packer 60 contains a swellable body 61, which forms the seal element for the packer 60 (for this example) and generally circumscribes an inner metal core of the tubing string 30. In some implementations, the swellable body 61 may be bonded to the metal core of the tubing string 30, and in general, the swellable body 61 may longitudinally extend (along the local longitudinal axis of the tubing string 30) between two gages, or drift rings (not shown), which limit/prevent longitudinal extrusion of the body 61.

As further discussed below, in accordance with example implementations, the swellable body 61 may be longitudinally segmented in that the body 61 may be formed in longitudinally arranged-segments. The materials of these segments have swelling properties that cooperate, as disclosed herein, to regulate the radial expansion of the body 61 when the body 61 swells, in a controlled manner that eliminates, or at least suppresses, the end effect.

Initially, the packer 60 is deployed downhole in its unset state, which means that the swellable body 61 is radially contracted, i.e., the swellable body 61 has not or at least has not significantly swollen while the tubing string 30 is being run into the well 10 as the swellable body 61 has not yet been exposed for a sufficient time to a triggering agent. After the tubing string 30 is appropriately positioned in the well 10, the swellable packer 60 is set, which means that the swellable body 61 swells to radially expand so that the body 61 forms an annular seal against the interior surface of the surrounding casing string 20.

For examples that are disclosed herein, the swellable material of the swellable material 61 swells in the presence of a triggering fluid, which is used to activate, or set the packer 60 to form the packer's annular seal. The triggering fluid may be, as examples, a well fluid that is naturally present in the well 10 or another triggering agent, which is introduced into the well 10 from the Earth surface E. As a more specific example, the swellable body 61 may be a swellable elastomeric material that swells due to thermodynamic absorption or fluid osmosis in the presence of a triggering agent, such as well fluid; oil; water; a triggering agent that is communicated from the Earth surface E of the well 10; a combination of one or more of these fluids; and so forth, depending on the particular implementation.

For the example that is depicted in FIG. 1; the packer 60, when set, forms an annular seal that isolates the stage 35 from an uphole segment of the wellbore 12, i.e., the set packer 60 isolates an annular region 34, which is outside of the screen assembly 40 and immediately downhole from the packer 60 from a corresponding uphole annular region 33 of the packer 60. It is noted that the annular seal may be used for purposes of isolating the zone 35 for such purposes as production, to perform a stimulation operation, to perform gravel packing, and so forth.

Figure 2:
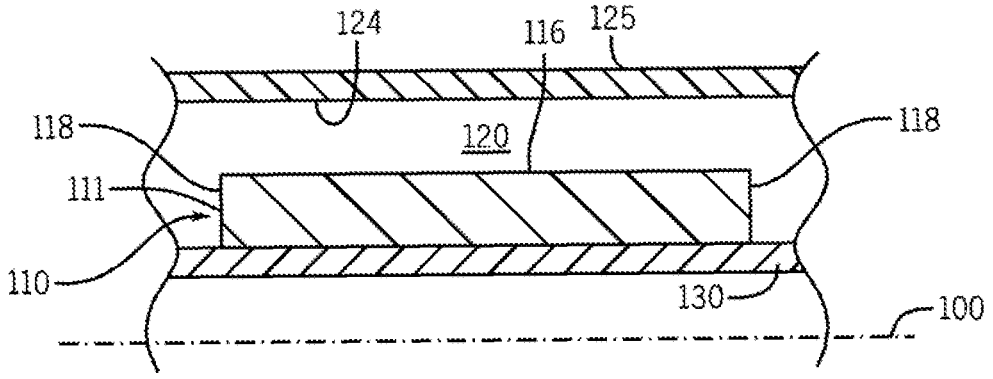
FIG. 2 a partial cross-sectional view of a swellable packer depicting the packer in its radially contracted, or unset, state.

Without the techniques and systems that are disclosed herein, challenges may exist in using a swellable packer to form an annular seal in a well due to the end effect. As an example, a swellable packer 110 that may potentially be subject to the end effect is depicted in FIG. 2. The swellable packer 110 longitudinally extends along a longitudinal axis 100 and is depicted in FIG. 2 in its unset state, i.e., a state in which a swellable body 111 (that circumscribes and is bonded to an interior tubular metal core 130) of the packer 100 is radially contracted, thereby leaving an annular space 120 between the body 111 and a surrounding casing string 125. It is noted that FIG. 2 depicts a partial cross-sectional view of the packer 110: the upper side of the packer's cross-section is depicted in FIG. 2, with it being understood that the packer 110 is generally symmetrical about the longitudinal axis 100 so that the lower side of the packer's cross section is, in general, a mirror image of the upper side. It is noted that the partial cross-sectional views of swellable packers that are depicted in FIGS. 3, 5A, 5B, 5C, 6, 7 and 8 follow the same convention, with it being understood that the lower side of each cross-section is generally a mirror image of the depicted upper side of the cross section.

Figure 3:
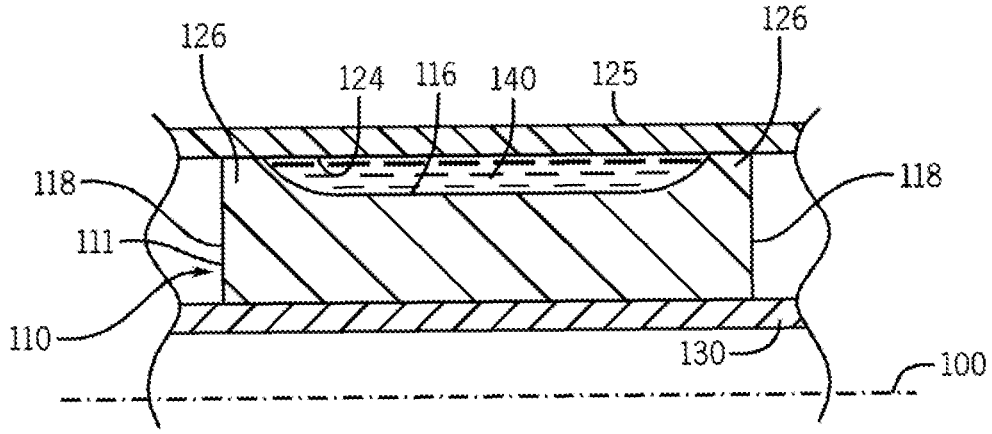
FIG. 3 is a partial cross-sectional view of the swellable packer of FIG. 2 depicting the packer in its radially expanded, or set, state.

Still referring to FIG. 2, for this example, the swellable packer body 111 is a homogenous body that has a nominally uniform swelling rate throughout but is subject to the end effect, which effectively imparts greater swelling rates to the body near its longitudinal ends 118. In other words, due to the end effect, the regions of the swellable packer body 111 near its longitudinal ends 118, in general, radially expand faster than a corresponding central portion 116 of the body 111. Referring to FIG. 3, thus, due to the end effect, when the swellable body 111 swells, the regions 126 of the swellable body 111 near the ends 118 contact an inner surface 124 of the casing string 125 first before the central portion 116 of the body 111 contacts the inner surface 124. This, in turn, creates a contained annular space 140 that extends longitudinally between the end portions and between the central portion 116 of the swellable body 111 and the casing string 125, which may trap well fluid in what is supposed to be a region in which an annular seal is formed.

The dynamics that give rise to the end effect are attributable to the mass flux concentration at the end of the swellable body reaching equilibrium before the mass flux concentration in the central portion of the swellable body reaches equilibrium. More specifically, the diffusivity (called "D" herein) of the triggering agent (oil, for example) through the swellable body (a rubber matrix, for example) governs the dynamics of the swelling process. Assuming that the D diffusivity is held constant and without considering coupling between rubber elasticity and swelling kinetics, the mass flux (called "M" herein) of the triggering agent in a homogenous, cylindrical hollow swellable packer body with no "end effect" (i.e., the body is assumed to have a theoretical infinite length) may be expressed as follows:

$$\frac{1}{D}\frac{\partial M}{\partial t} = \frac{\partial^2 M}{\partial r^2} + \frac{1}{r}\frac{\partial M}{\partial t}, \qquad \text{Eq. 1,}$$

where "r" represents the radius of the cylinder and "t" represents time. The boundary conditions and initial conditions that are assumed in the derivation of Eq. 1 are set forth below in Eqs. 2 and 3, respectively:

$$\frac{\partial M(r_i, t)}{\partial r} = 0 \quad \frac{\partial M(r_o, t)}{\partial r} = H[M_{eq} - M(r_o, t)], \qquad \text{Eq. 2}$$

and $$M(r, 0) = V_i = 0, \qquad \text{Eq. 3,}$$

where "$r_i$" represents the inner radius of the swellable body; "$r_o$" represents the outer radius of the swellable body; "$M_{eq}$" represents the M mass flux concentration at equilibrium; and "H" represents the film mass transfer.

The solution to Eq. 1 in terms of the M mass flux concentration at any time may be described as follows:

$$M(t) = M_{eq}\left[1 - \sum_{n=1}^{\infty} \frac{2}{\lambda_n} \frac{C_1(\lambda_n)C_0\left(\lambda_n \frac{r_i}{r_0}\right)}{\lambda_n C_1^2(\lambda_n) - a^2 C_0^2(\lambda_n a)}\right], \qquad \text{Eq. 4}$$

where "$C_0$" and "$C_1$" represent cylinder functions from zero and first order Bessel functions; "λ" represents the eigenvalue/roots; and "a" represents the ratio of the inner and outer diameters of the swellable cylinder.

To capture the axial mass transfer or end effects (i.e., for a finite length swellable packer body), Eq. 1 may be redefined with same boundary and initial conditions that are set forth in Eqs. 2 and 3, as described below:

$$\frac{1}{D}\frac{\partial M}{\partial t} = \frac{\partial^2 M}{\partial r^2} + \frac{1}{r}\frac{\partial M}{\partial t} + \frac{\partial^2 M}{\partial r^2}, \qquad \text{Eq. 5}$$

The solution to Eq. 5 in terms of the M mass swell flux concentration as a function of time and axial position (called "z," where z varies between 0 and L, the length of the swellable cylinder) may be described as follows:

$$M(z, t) = 1.5\alpha M_{eq}\left[1 - \frac{16}{1-\alpha^2}\sum_{n=1}^{\infty}\sum_{m=1,3,5}^{\infty}\frac{2}{\lambda_n}\frac{C_1(\lambda_n)C_0\left(\lambda_n\frac{r}{r_0}\right)\sin\left(m\pi\frac{z}{L}\right)}{\lambda_n C_1^2(\lambda_n) + C_0(\lambda_n) - a^2 C_0^2(\lambda_n a)\lambda_n^2} e^{-\left(\frac{\lambda_n^2}{r_o^2} + \frac{m^2\pi^2}{L^2}\right)Dt}\right]. \qquad \text{Eq. 6.}$$

As set forth in Eq. 6, the M mass flux concentration near the end of the finite length cylinder reaches equilibrium rather quickly, as compared to the central portion of the cylinder; and as a result, the ends swell more rapidly than the central portion. The impact of the end effect may be reduced when the D diffusivity changes with the M mass flux concentration; however, the fact that the elastomer at the end of the swellable body swells more rapidly than the center portion of the body remains. At the both ends (z=0, and z=L), the fluid and swellable body contact surface increases, and the swelling rate also increases, which also leads to a larger displacement of the swellable body near the ends.

Figure 4:
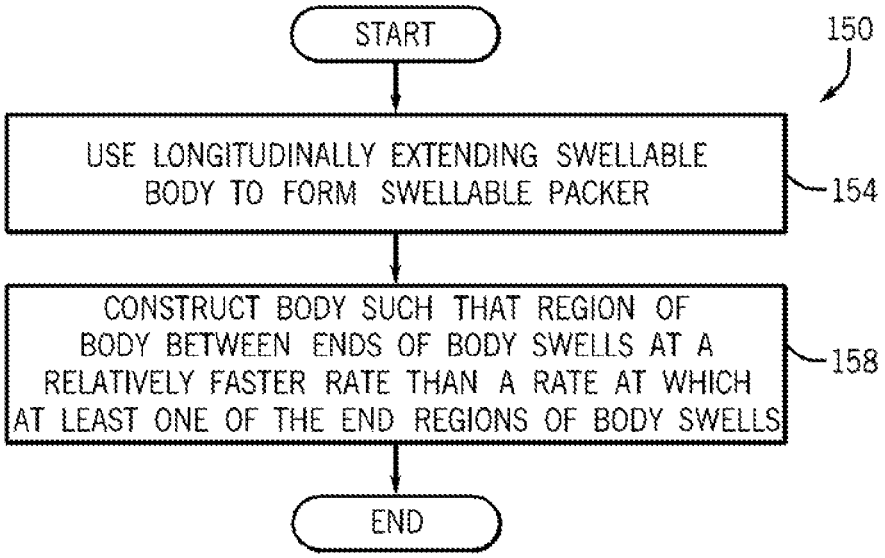
FIG. 4 is a flow diagram depicting a technique to suppress an end effect for a swellable packer according to an example implementation.

Referring to FIG. 4, for purposes of suppressing, if not eliminating, the end effect, a technique 150 may be used, in accordance with example implementations. Pursuant to the technique 150, a longitudinally extending swellable body is used (block 154) to form a swellable packer. The body is constructed such that a region of the body between ends of the body swells relatively faster rate than a rate at which at least one of the end regions of the body swells, pursuant to block 158.

Among the potential advantages of eliminating or at least suppressing the end effect for the swellable body, the pressure performance and reliability of the swellable packer may be enhanced. The elimination/suppression of the end effect means that the ends of the swellable packer body are supported by the central portion of the swellable packer, thereby extending the lifetime of the packer. A swellable packer having a suppressed end effect may be used in operations, such as multiple stage fracturing operations, in which relatively large magnitude differential pressure exists across the swellable body. Moreover, the length of the swellable packer may be decreased due to the more effective seal created by the swellable body, which minimizes risks of the packer becoming lodged in the well while being run in hole and minimizes product costs. Other and different advantages are contemplated, in accordance with further implementations.

In accordance with example implementations, the swellable body of the swellable packer may be longitudinally segmented, i.e., the swellable body may be formed from a concatenation of swellable body cylinders, or rings, which are arranged end to end along the swellable body's longitudinal axis and circumscribe the packer's inner core. The segments of the swellable body are formed from materials that have differing swelling rates for purposes of regulating the spatial profile of the swelling to eliminate/suppress the end effect.

Figure 5A:
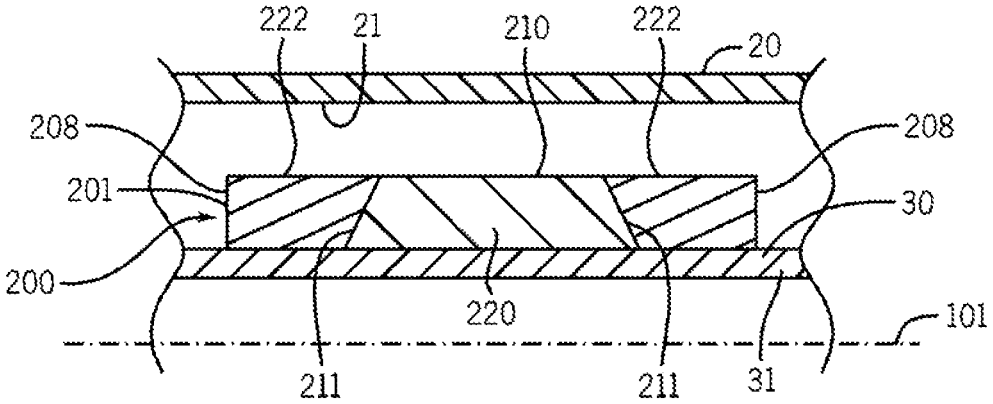
FIGS. 5A, 5B and 5C depict partial cross-sectional views of a swellable packer depicting the packer in unset (FIG. 5A), set (FIG. 5C) and intermediate (FIG. 5B) states according to an example implementation.

As a more specific example, FIG. 5A depicts a partial cross-sectional view of a longitudinally segmented swellable packer 200, in accordance with example implementations.

The swellable packer 200 represents a specific example implementation of the packer 60 of FIG. 1.

Referring to FIG. 5A in conjunction with FIG. 1, in general, the swellable packer 200 includes a longitudinally segmented swellable body 201 that extends along a local longitudinal axis 101 of the tubing string 30 and is bonded to an inner metal tubular core 31 (of the string 30), which the body 201 circumscribes. In accordance with an exemplary implementation, the swellable body 201 includes two different materials to counteract the end effect: a first material 208 that forms end segments 222 of the swellable body 201 and has a nominally relatively smaller swelling rate; and a second material 210 that forms a central segment 220 of the swellable body 201 and which has a nominally relatively larger swelling rate. The different swelling rates may be established, for example, by different mass film transfer parameters for the materials 208 and 210 due to various elastomeric and additives compositions.

In accordance with some implementations, the swelling rate may be varied by regulating the amount of EPDM (ethylene propylene diene monomer) of the swellable material. In this manner, in accordance with some implementations, the central segment material 210 may have a higher percentage of EPDM than the material 208 that forms the end segments 222. In accordance with some implementations, ignoring the end effect, the central segment material 210 may have a nominal swelling rate that is about fifty percent greater than the nominal swelling rate of the end segment material 208.

In accordance with some implementations, the materials that form the swellable body 201 may be formed from elastomeric compounds, such as the compounds disclosed in U.S. Pat. No. 7,373,991 B2, which are formed from the reaction product of a linear or branched polymer having residual ethylenic unsaturation with an ethylenically unsaturated organic monomer having at least one reactive moiety selected from the group consisting of acid, acid anhydride, and acid salt.

As their names imply, the central segment 220 longitudinally extends between and separates the two end segments 222. Moreover, in accordance with example implementations, each end segment 222 is bonded to a respective longitudinal end of the central segment 220 at a corresponding boundary 211.

Although end segment 222 may swell relatively faster than predicted due to the mass flux concentration of the segment 222 reaching equilibrium relatively quickly, the actual swelling rate of the end segment 222 remains smaller than the actual swelling rate of the central segment 220 to cause the segment 220 to form its seal first. Therefore, due to the differences in swell rates, when the swellable body 201 swells, the central segment 220 swells more rapidly to contact the inner surface 21 of the casing string 20 first before either end segment 222, thereby precluding the formation of a fluid trapping pocket (i.e., thereby suppressing if not eliminating the end effect). Thus, although the mass flux concentration in each end segment 222 reaches equilibrium more rapidly than the mass flux concentration in the central segment 220, the swelling rate of the central segment 220 is sufficiently large to overcome this discrepancy and form a seal with the casing 20 before the end segments 222 form their respective seals.

Figure 5B:
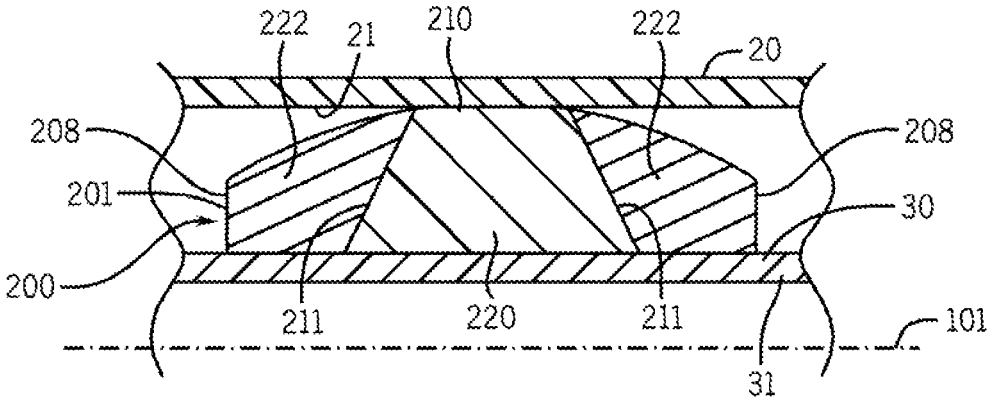
Figure 5C:
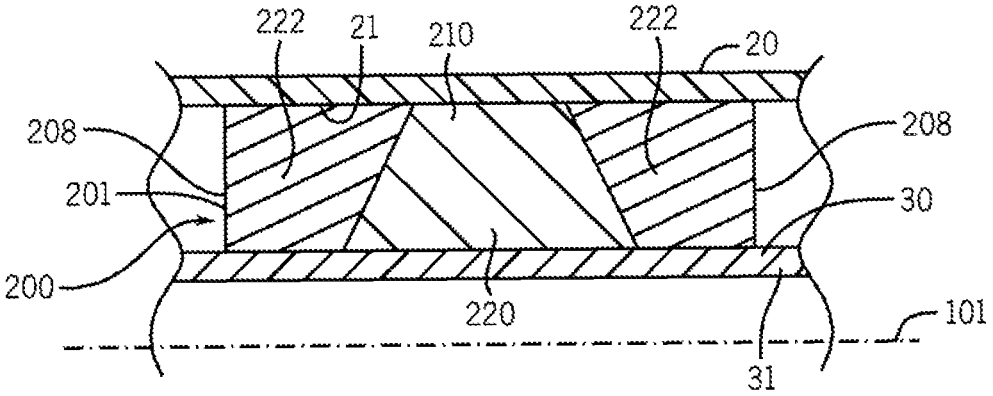

FIG. 5B depicts an intermediate state during the swelling of the swellable body 201, in accordance with example implementations. For this example, the swellable body's central segment 220 is the first segment to contact the inner surface 21 of the casing string 20; and in general, due to the bonding of the segments 220 and 222 together, the central segment 220 exerts radial forces to radially extend the end segments 222, as depicted in FIG. 5B. Thus, for the state of the swellable body 201 depicted in FIG. 5B, the end segments 222 have not yet made contact with the interior surface 21 of the casing string 20. Referring to FIG. 5C, when the swellable body 201 fully radially expands along its entire longitudinal length, the end segments 222 fully contact the inner surface 21 of the casing string 20 to fully form the annular seat for the swellable packer 200.

Referring back to FIG. 5A, in accordance with example implementations, the boundaries 211 between the end segments 222 and the central segment 220 are inclined, or tapered, with respect to the longitudinal axis 101. More specifically, as depicted in FIG. 5A, the boundary 211 varies both with respect to a radial offset from the core 31 and a longitudinal offset along its length. For the example that is depicted in FIG. 5A, the boundaries 211 are oriented so that the central segment 220 becomes longitudinally thinner with radial distance from the core 31; and conversely, the end segments 222 each becomes longitudinally thicker with radial distance from the core 31.

Figure 6:
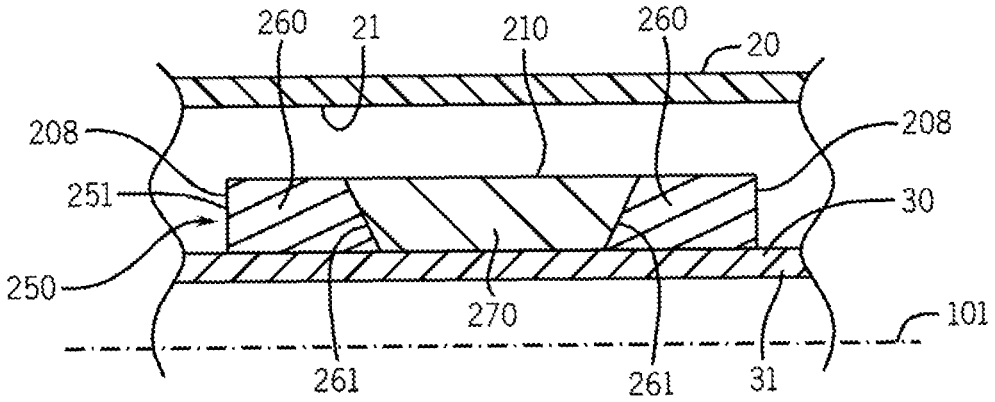
FIGS. 6, 7 and 8 depict partial cross-sectional views of swellable packers in unset states according to further example implementations.
Figure 7:
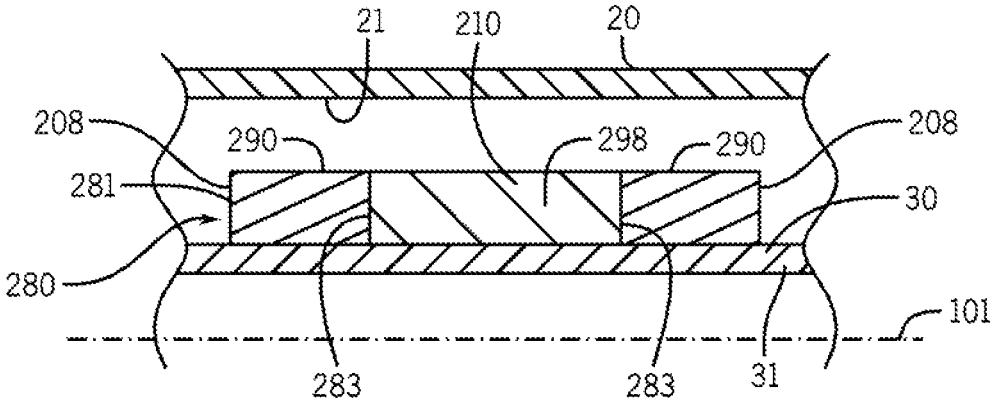

As another example, FIG. 6 depicts a swellable packer 250 in accordance with further implementations, which may be used as the swellable packer 60 of FIG. 1. Referring to FIG. 6, the swellable packer 250 includes a longitudinally segmented, swellable body 251, that includes end segments 260 that are formed from the relatively slower swelling material 208 and replace the respective end segments 222 (see FIG. 5A, for example) of the packer 200. The swellable packer 250 further includes a central segment 270 that is formed from the relatively faster swelling material 210 and replaces the central segment 220 of the packer 200.

Each end segment is bonded to a different end of the central segment 270; and the segments 260 and 270 are bonded to the core 31. Unlike the packer 200, boundaries 261 between each end segment 260 and the central segment 270 are tapered with respect to the longitudinal axis 101 in a manner such that the longitudinal thickness of the central segment 270 increases with radial distance from the core 31, and conversely, each of the end segments 260 becomes longitudinally thinner with radial distance from the core 31.

As another example, a swellable packer 280 (see FIG. 7) may alternatively be used for the packer 60 of FIG. 1 in further implementations. The packer 280 has a longitudinally segmented swellable body 281 that includes end segments 290 (formed from the material 208) and central segments 298 (formed from the material 210), which replace the corresponding end and central segments of the swellable packers 200 (see FIG. 5A, for example) and 250 (FIG. 6). The end segments 290 are bonded to different ends of the central segment 298; and the segments 290 and 298 are bonded to the core 31. Unlike these other swellable packers, boundaries 283 between the end 290 and central 298 segments are generally orthogonal to the longitudinal axis 101, i.e., the boundaries are not tapered. Thus, the longitudinal thickness of each segment 290, 298 generally does not vary with respect to the radial distance from the core 31.

Figure 8:
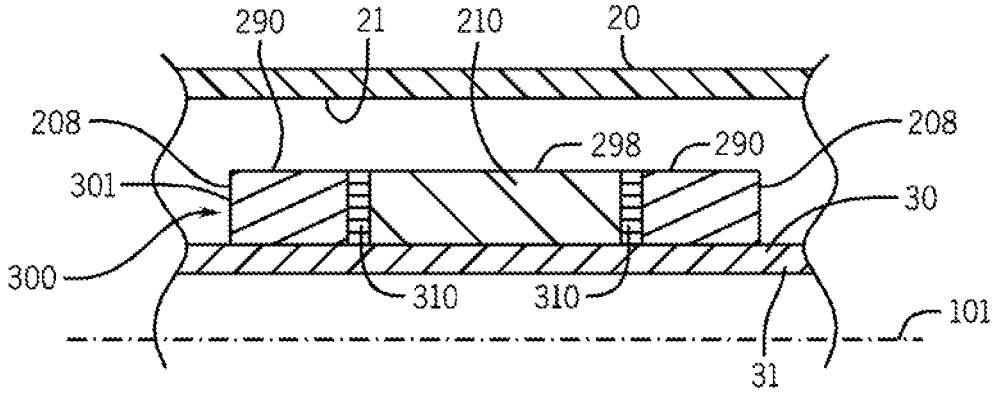

As yet another variation, a swellable packer 300 that is depicted in FIG. 8 may be used in further implementations for the packer 60 of FIG. 1. The swellable packer 300 includes a longitudinally segmented swellable packer body 301 that includes the end 290 and central 210 segments of the packer 280 (FIG. 7), which are bonded to the inner core 30. However, unlike the packer 280, a spacer 310 that is disposed between, and thus, separates, each end segment 290 from an adjacent end of the central segment 298.

The spacer 310 may be formed from one of a number of different materials, depending on the particular implementation. For example, in accordance with some implementations, the spacer 310 may be formed from a non-swellable material (an elastomer-based non-swellable material, for example). In other implementations, the spacer 310 may be formed from a swellable material that has a different swelling rate than either the central 298 or end 290 segment (a material having a swelling rate less than the swelling rate of the central segment 298 but greater than the swelling rate of the end segment 290, for example).

Other variations are contemplated, which are within the scope of the appended claims. For example, in further implementations, a swellable packer may include a longitudinally segmented swellable body that is formed from more than three segments (ten or more segments, for example) of materials having differing swelling rates. In further implementations, the swellable packer body may be a monolithic body and thus, not a non-segmented body, whose swelling rate varies with longitudinal position along the body so that central portion of the body swells more rapidly than end portions of the body.

While a limited number of examples have been disclosed herein, those skilled in the art, having the benefit of this disclosure, will appreciate numerous modifications and variations therefrom. It is intended that the appended claims cover all such modifications and variations

What is claimed is:

1. A packer usable with a well, comprising:

a tubular inner core; and a swellable longitudinally segmented body mounted to the core and being adapted to swell in the presence of a triggering agent to form an annular seal at an inner surface of the well, the swellable body longitudinally extending between first and second ends of the body and comprising:

a first region forming a first segment of a first material located between the first and second ends of the swellable body having an exposed surface to swell at a first rate and into sealing engagement with the inner surface;

a second region forming a second segments of a second material, the second segments located closer to each of the first and second ends than the first region, the second segments having exposed surfaces exceeding an amount of the exposed surface of the first segment and to swell at a second rate and into sealing engagement with the inner surface and at a rate that is less than the first rate; and a boundary between the first and second segments, the boundary tapered to tailor an increased surface exposure of one of the first and second segments to the well and triggering agent.

2. The packer of claim 1, wherein a difference between the first and second rates results in a centrally-disposed portion of the swellable body fully radially expanding before at least a portion of the body disposed near one of the first and second ends fully radially expands.

3. A method comprising:

tailoring a swellable body with a tapered boundary between first and second segments, for an increased surface exposure of one of the segments to a triggering agent in a well;

using the swellable body to form an annular seal in the well; and preventing fluid from being trapped by the swellable body in response to the swellable body radially expanding, wherein preventing the fluid from being trapped comprises:

radially expanding a first region with an exposed surface of the swellable body disposed between ends of the body at a first speed of swelling in response to the exposure; and radially expanding second regions of the swellable body with exposed surfaces exceeding an amount of the exposed surface of the first region and disposed closer to the ends than the first region at a second speed of swelling less than the first speed of swelling in response to the exposure.

4. The method of claim 3, wherein radially expanding the first region of the swellable body comprises providing a first material for the first region and providing a second material for the second regions, the first material having a greater swelling rate than a swelling rate of the second material.

5. The method of claim 4, wherein radially expanding the first region of the swellable body further comprises:

creating a boundary between the first and second materials, the boundary being tapered with respect to a longitudinal axis of the swellable body.

6. A system usable with a well, comprising:

a tubing string to extend downhole in the well; and a packer to form an annular seal between the tubing string and a casing or wellbore wall, the packer comprising:

an inner core; and a swellable longitudinally segmented body mounted to the inner core to swell to form an annular seal in the well at the casing or wellbore wall, the swellable body being mounted to and circumscribing the inner core and comprising:

a first segment disposed apart from longitudinal ends of the swellable body, the first segment comprising a first material associated with a first swelling rate for swelling an exposed surface into sealing engagement with the casing or wellbore wall;

second segments disposed near the longitudinal ends of the swellable body, each of the second segments comprising a second material associated with a second swelling rate with exposed surfaces exceeding an amount of the exposed surface of the first segment and for swelling into sealing engagement with the casing or wellbore wall; and a boundary between the first and second segments tapered to tailor an increased surface exposure of one of the first and second segments to the well, wherein the first and second swelling rates differ to cause the first segment form a seal with the tubing string or casing before either of the second segments forms a seal with the tubing string or casing.

7. The system of claim 6, wherein the first segment is bonded to at least one of the second segments.

8. The system of claim 6, wherein the first swelling rate is greater than the second swelling rate.

9. The system of claim 6, wherein the first segment comprises a central segment that longitudinally extends between the second regions and is bonded to the second regions.

10. The system of claim 6, wherein the tubing string is selected from the group consisting of a work string and a production string.

* * * * *